US007855663B2

(12) United States Patent
Wilbrink et al.

(10) Patent No.: US 7,855,663 B2
(45) **Date of Patent: *Dec. 21, 2010**

(54) SYSTEM FOR UTILIZING RFID TAGS TO MANAGE AUTOMOTIVE PARTS

(75) Inventors: Tijs I. Wilbrink, Leiden (NL); Edward E. Kelley, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 300 days.

This patent is subject to a terminal disclaimer.

(21) Appl. No.: 12/141,411

(22) Filed: Jun. 18, 2008

(65) Prior Publication Data

US 2008/0284571 A1 Nov. 20, 2008

Related U.S. Application Data

(63) Continuation of application No. 11/163,646, filed on Oct. 26, 2005, now Pat. No. 7,400,268.

(51) Int. Cl.
*G08G 1/01* (2006.01)

(52) U.S. Cl. ..... 340/933; 340/438; 340/572.1; 340/568.1; 701/1

(58) Field of Classification Search ..... 340/933, 340/438, 572.1, 568.1; 701/1
See application file for complete search history.

(56) References Cited

U.S. PATENT DOCUMENTS

| | | | |
|---|---|---|---|
| 6,820,897 | B2 | 11/2004 | Breed et al. |
| 6,898,489 | B1 | 5/2005 | Hayes, Sr. |
| 6,982,653 | B2 | 1/2006 | Voeller et al. |
| 7,042,346 | B2 | 5/2006 | Paulsen |
| 7,099,728 | B2 | 8/2006 | Urabe |
| 2002/0089434 | A1 | 7/2002 | Ghazarian |
| 2002/0140215 | A1 | 10/2002 | Breed et al. |
| 2004/0263334 | A1 | 12/2004 | Hasegawa et al. |

*Primary Examiner*—Daryl Pope
(74) *Attorney, Agent, or Firm*—Ronald A. Kaschak; Hoffman Warnick LLC

(57) ABSTRACT

A system for utilizing RFID tags to manage automotive parts. A system is provided that includes a radio frequency identification (RFID) reader configured to read data from RFID tags affixed to parts located throughout a vehicle, wherein each RFID tag uniquely identifies a part; a data processing system configured to process the data obtained by the RFID reader; and a service application that provides service related information to an end user based on an installation or removal of a part from the vehicle.

12 Claims, 9 Drawing Sheets

| | Part #1; ID = 1AA | Part #2; ID = 2AA | Part #2; ID = 2AB |
|---|---|---|---|
| Date first installation | 01-01-2005 | 03-01-2005 | 03-12-2005 |
| Part repaired, replaced or maintenance | NA | Replaced | Maintenance |
| Cost of activity; cost of part; cost of fluids | NA | Activity: 50$; Part: 31$; Fluids: NA | Activity: 15$; Part: NA; Fluids: NA |
| Known breakdowns of part in past? Reference to record. | | Yes; record ID = 2AB | Yes; record ID = 2AB |
| Contact details for part manufacturer; contact details for repair garage | | Auto parts LLG; NY etc.<br>Auto Maintenance LLG; TX, etc | Auto parts LLG; NY etc.<br>Auto Maintenance LLG; TX, etc |
| (Optional) Past breakdowns from peers, from online repository | | | |

FIG. 2

| | Part #1 | Part #2 |
|---|---|---|
| Original part as delivered by manufactured | Yes | No |
| Part modified after first installation | No | Yes |
| Brand / Type similar to original configuration | Yes / Yes | Yes / No |
| … | | |

TABLE 1

| | Part #1 | Part #2 |
|---|---|---|
| Installed from mileage | 0 miles | 80,000 miles |
| Car's related warning systems active before arrival | No | No |
| Date installation / modification | 01-01-2005 / NA | 03-01-2005 / 03-12-2005 |
| … | | |

TABLE 2

FIG. 3

SYSTEM FOR UTILIZING RFID TAGS TO MANAGE AUTOMOTIVE PARTS

CROSS-REFERENCE TO RELATED APPLICATIONS

This continuation application claims priority to U.S. patent application Ser. No. 11/163,646, entitled SYSTEM AND METHOD FOR UTILIZING RFID TAGS TO MANAGE AUTOMOTIVE PARTS, filed on Oct. 26, 2005, now U.S. Pat. No. 7,400,268.

BACKGROUND OF THE INVENTION

1. Technical Field

The present invention relates generally to the management of automotive parts, and more specifically relates to a system for utilizing RFID tags to manage and track parts in a vehicle.

2. Related Art

Obtaining effective automotive maintenance continues to be a major headache for consumers. Because the maintenance is typically done "beneath the hood," the average consumer has no idea what maintenance was actually performed on the automobile. This inability to readily validate the actual maintenance done can lead to fraudulent activities by the service provider. For instance, service providers can easily over-bill a consumer by claiming to perform work that was not actually done, by performing services that were not necessary, by using refurbished or substandard parts, etc.

While the initial fraudulent act may be minor, such an act may lead to a more severe impact. For instance, a substandard air filter on a high performance vehicle can result in significant engine damage. Unfortunately, there is no current process available to consumers that allow them to easily validate the maintenance work performed by a service provider. Accordingly, a need exists for such a system and method that can intelligently keep track of parts in an automobile.

SUMMARY OF THE INVENTION

The present invention addresses the above-mentioned problems, as well as others, by providing a system that collects and analyzes information on car servicing by using RFID tags mounted on automotive parts, an RFID reader, and a central processing system for managing part information. With such capabilities, a consumer can readily determine what work was actually performed; obtain cost estimations for work performed; identify substandard or incorrect parts, keep track of maintenance histories, etc.

In a first aspect, the invention provides a system for managing parts information in a vehicle, comprising: a radio frequency identification (RFID) reader configured to read data from RFID tags affixed to parts located throughout the vehicle, wherein each RFID tag uniquely identifies a part; a data processing system configured to process the data obtained by the RFID reader; and a service application that provides service related information to an end user based on an installation or removal of a part from the vehicle.

In a second aspect, the invention provides a method for managing parts information in a vehicle, comprising: reading data from RFID tags affixed to parts located throughout the vehicle, wherein each RFID tag uniquely identifies a part; storing the data obtained by the RFID reader in a database; and generating service related information to an end user based on an installation or removal of a part from the vehicle.

In a third aspect, the invention provides a vehicle having a system for managing parts information, comprising: a plurality of parts, each having an RFID tag that uniquely identifies the part; an RFID reader configured to read data from the RFID tags; a computer system having: a data processing system configured to process parts data obtained by the RFID reader; a database for storing parts data; and a service application that provides service related information to an end user based on a detected part installation in or removal from the vehicle.

BRIEF DESCRIPTION OF THE DRAWINGS

These and other features of this invention will be more readily understood from the following detailed description of the various aspects of the invention taken in conjunction with the accompanying drawings in which:

FIG. 2 depicts an illustrative parts tracking report that provides maintenance and replacement history.

FIG. 3 depicts a pair of illustrative tables that can stored or derived from the information in a parts database.

DETAILED DESCRIPTION OF THE INVENTION

Figure 1:
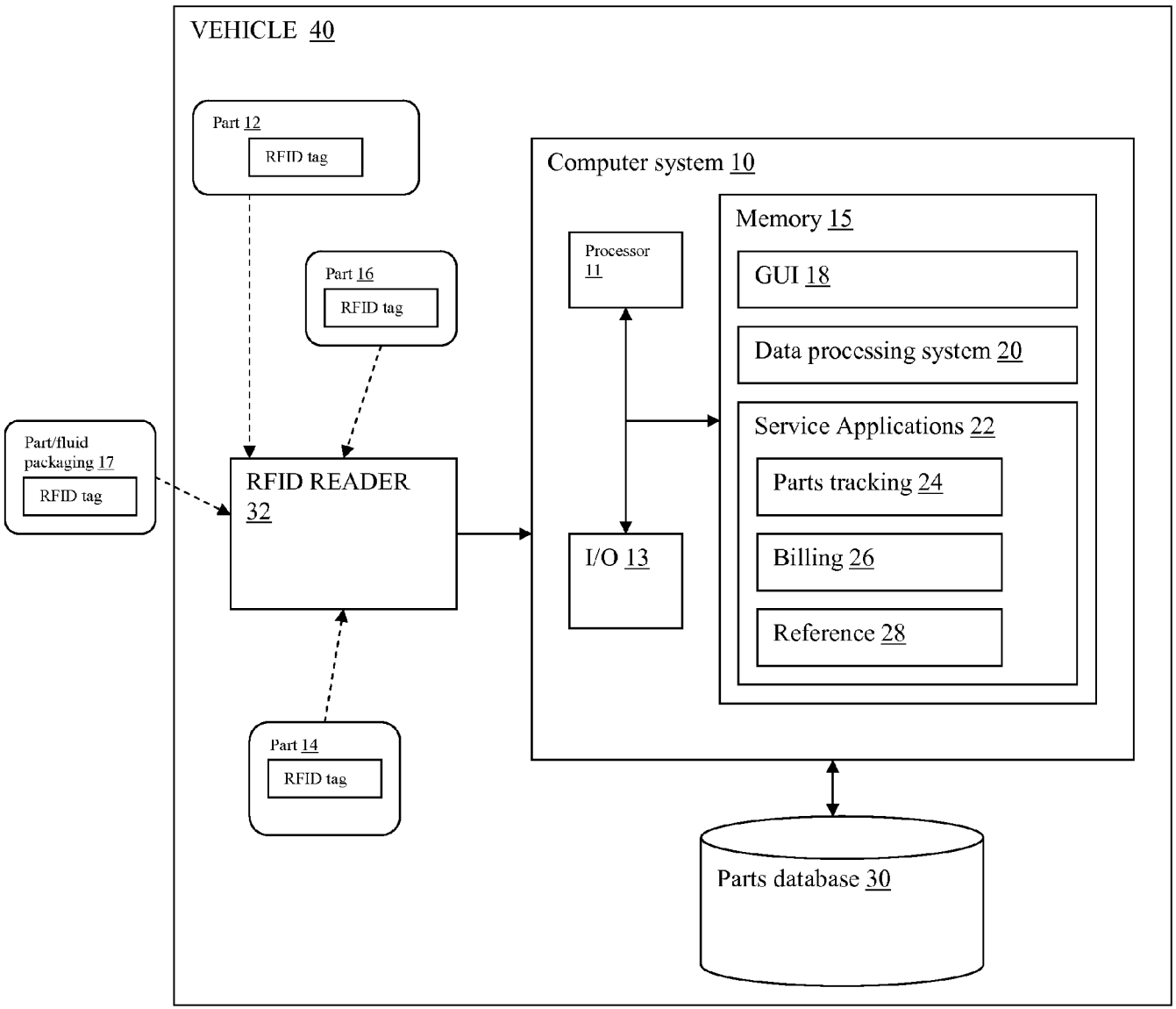
FIG. 1 depicts an automobile having a parts processing system in accordance with the present invention.

Referring now to drawings, FIG. 1 depicts a vehicle 40 having a parts management system in accordance with the present invention. The parts management system includes an RFID (radio frequency identification) reader 32, a computer system 10 and a parts database 30. Included in the vehicle 40 are a plurality of parts 12, 14, and 16, with each part including a unique RFID tag. Each RFID tag emits a signal that can be read by RFID reader 32 to provide information about various the parts 12, 14, and 16 in the vehicle 40. Once detected, the parts information can be passed from the RFID reader 32 to computer system 10, where the data can be managed, e.g., displayed, processed, stored in parts database 30, etc. Note that vehicle 40 may comprise any type of transportation machine, including, but not limited to, cars, trucks, motorcycles, boats, trains, airplanes, etc.

The use of RFID tags is readily known in the art, and is therefore not discussed in further detail. In one illustrative embodiment, each RFID tag may include a unique code that specifically identifies the part. Illustrative information provided by each RFID tag may include, e.g., an identifier, a part number, a part type, the manufacturer, whether the part is a new or refurbished part, if it is original equipment for the vehicle 40, if is a non-brand part, etc. Note that otherwise identical parts should not share the same identifier in order to allow replacement parts to be uniquely identified.

In this illustrative embodiment, computer system 10 includes: (1) a data processing system 20 for processing the parts information received by RFID reader 32; (2) a graphical user interface (GUI) 18 for displaying parts related information; and (3) a set of servicing applications 22 that manipulate the parts information for service (i.e., maintenance) related activities performed on the vehicle.

Data processing system 20 is primarily responsible for obtaining data from the RFID reader 32 and storing/retrieving data from the parts database 30. The parts database 30 provides details and history for each part 12, 14, and 16 being tracked by the parts management system. Obviously, the number and type of parts being tracked can vary. In addition, information may also be collected from an RFID tag embedded in part/fluid packaging 17, which does not actually reside in the vehicle 40. For example, an RFID tag may be place in an oil container. When the oil container is brought near the car (presumably to be put in the engine), the RFID reader 32 can pass the information to computer system 10 about the specific type of oil being used.

In addition, data processing system may be linked to a network, such as the Internet or cellular network to, for instance, enhance the parts information obtained from the RFID tags, download additional information, validate the service, etc. For example, the RFID tag may simply provide a code that can be decoded by a remote server to provide extensive part information. Alternatively, as described in further detail below, data processing system 20 may be utilized download documentation or reference material, such as recall information, warranty information, bulletins, etc., about parts in the vehicle 40.

The illustrative embodiment of FIG. 1 includes a set of service applications 22 that provide service related information to an end user based on an installation or removal of one or more parts from the vehicle. Illustrative service applications 22 include a parts tracking application 24, a billing application 26, and a reference application 28. Obviously, the number and type of service applications 22 can vary depending on the particular information to be presented.

The parts tracking application 24 keeps track of parts as they are removed and/or installed in the vehicle 20. Thus, a consumer is able to verify what work was actually performed by a service provider on a given date/time. This information could also be shared with any potential purchaser of the vehicle. The information could also be uploaded to a server along with data from other vehicles to identify and track problematic parts, service mistakes, etc. FIG. 2 depicts an illustrative parts tracking report that provides maintenance and replacement history for three different part ID's. Obviously, the type and amount of information provided in such a report could vary.

Billing application 26 provides a system for generating cost estimates for parts and services provided by a service provider. For example, if it was detected that the service provider replaced three parts, the billing application 26 could generate a cost estimate for the work performed. This estimate could then be compared to the actual bill to determine whether the consumer was being overcharged. Information about the actual bill could be stored and used at a later time, and such information could be remotely shared with other users.

Reference application 28 provides a system for cross referencing parts against reference material, such as manufacturers' documentation, owner's manuals, catalogs, warranty information, product bulletins, etc. Accordingly, when a service provider installs a new part, reference application 28 can ensure that an acceptable part is being used. For instance, if the manufacturer calls for a specific brand part, and the service provider installs a substandard part, a warning can be generated.

In general, computer system 10 may comprise any type of computing device (including a handheld device), and could be implemented as part of a client and/or a server. Computer system 10 generally includes a processor 11, input/output (I/O)13, memory 15, and a bus. The processor 11 may comprise a single processing unit, or be distributed across one or more processing units in one or more locations, e.g., on a client and server. Memory 16 may comprise any known type of data storage and/or transmission media, including magnetic media, optical media, random access memory (RAM), read-only memory (ROM), a data cache, a data object, etc. Moreover, memory 16 may reside at a single physical location, comprising one or more types of data storage, or be distributed across a plurality of physical systems in various forms.

I/O 13 may comprise any system for exchanging information to/from an external resource. External devices/resources may comprise any known type of external device, including a monitor/display, speakers, storage, another computer system, a hand-held device, keyboard, mouse, voice recognition system, speech output system, printer, facsimile, pager, etc. The bus provides a communication link between each of the components in the computer system 10 and likewise may comprise any known type of transmission link, including electrical, optical, wireless, etc. Although not shown, additional components, such as cache memory, communication systems, system software, etc., may be incorporated into computer system 10.

Computer system 10 may be linked to a network such as the Internet, a local area network (LAN), a wide area network (WAN), a virtual private network (VPN), etc. Communication could occur via a wireless transmission method.

Parts database could be implemented in any fashion, e.g., as a relational database, a flat file, a data object, etc. FIGS. 3 depicts a pair of illustrative tables that could be stored or derived from the information in parts database 30. In these examples, Table 1 provides a registration of RFID tagged parts, and Table 2 depicts a registration of relevant part information based on part type and activity.

Figure 4:
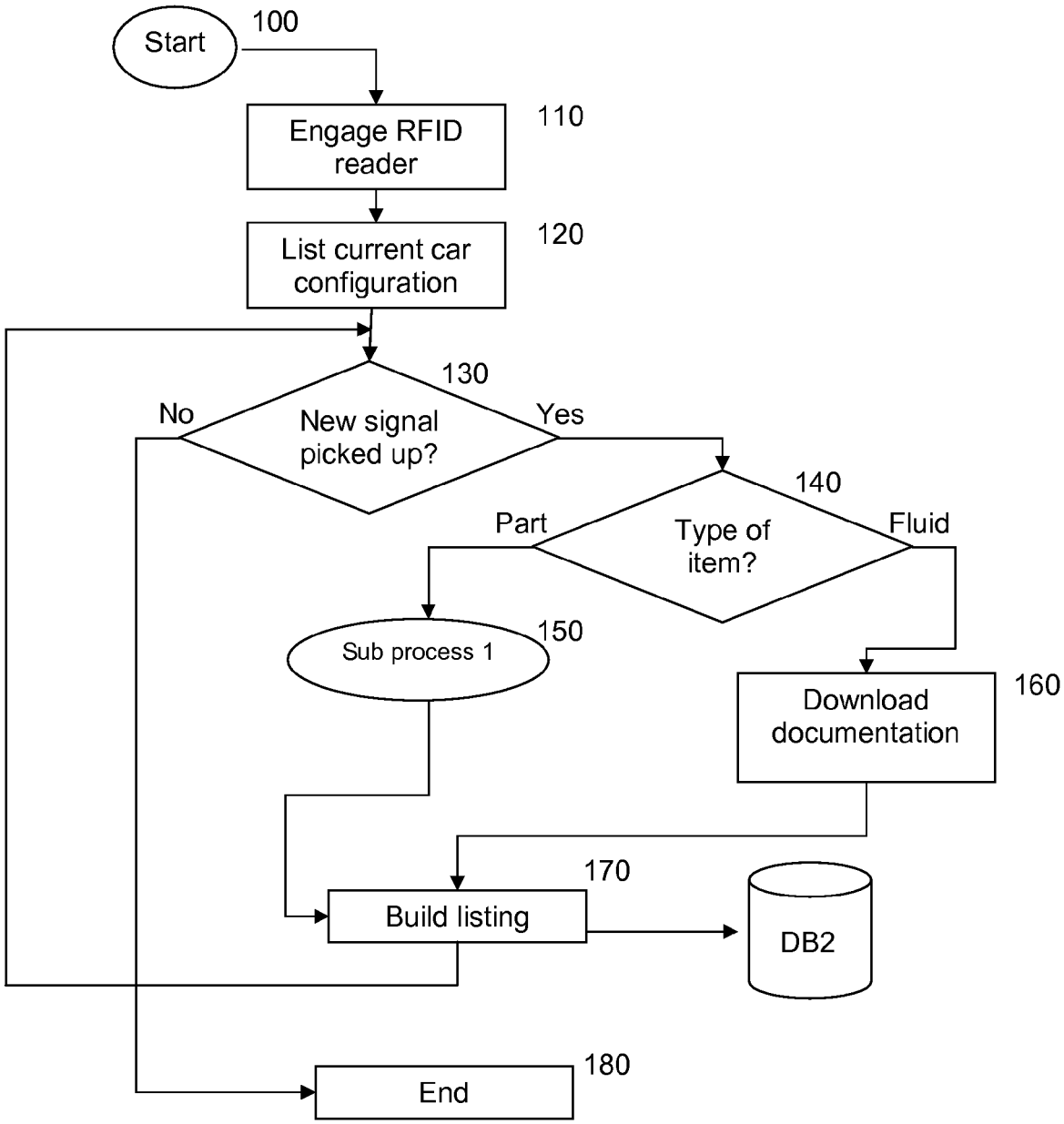
FIG. 4 depicts an illustrative flowchart of a parts tracking application.

FIG. 4 depicts an illustrative flowchart of a parts tracking application 24. The process is started at step 100, e.g., when the hood is opened, the car is lifted, or simply activated by an end user. At step 110, the RFID reader in engaged. At step 120 a listing of currently present devices is created using RFID signals. At step 130, a determination is made whether any new RFID signals are picked up. If so, at step 140, the type of item of which an RFID signal was picked up is detected. If it is a part, then sub process 1 is initiated at step 150 to derive information on the identified part. (See FIG. 5 for further details.) If it is a fluid, then at step 160, documentation on the fluid is downloaded/examined based on the information that was sent by the RFID signal. At step 170, a list of every new item that was detected during maintenance is built, and at step 180, the process ends.

Figure 5:
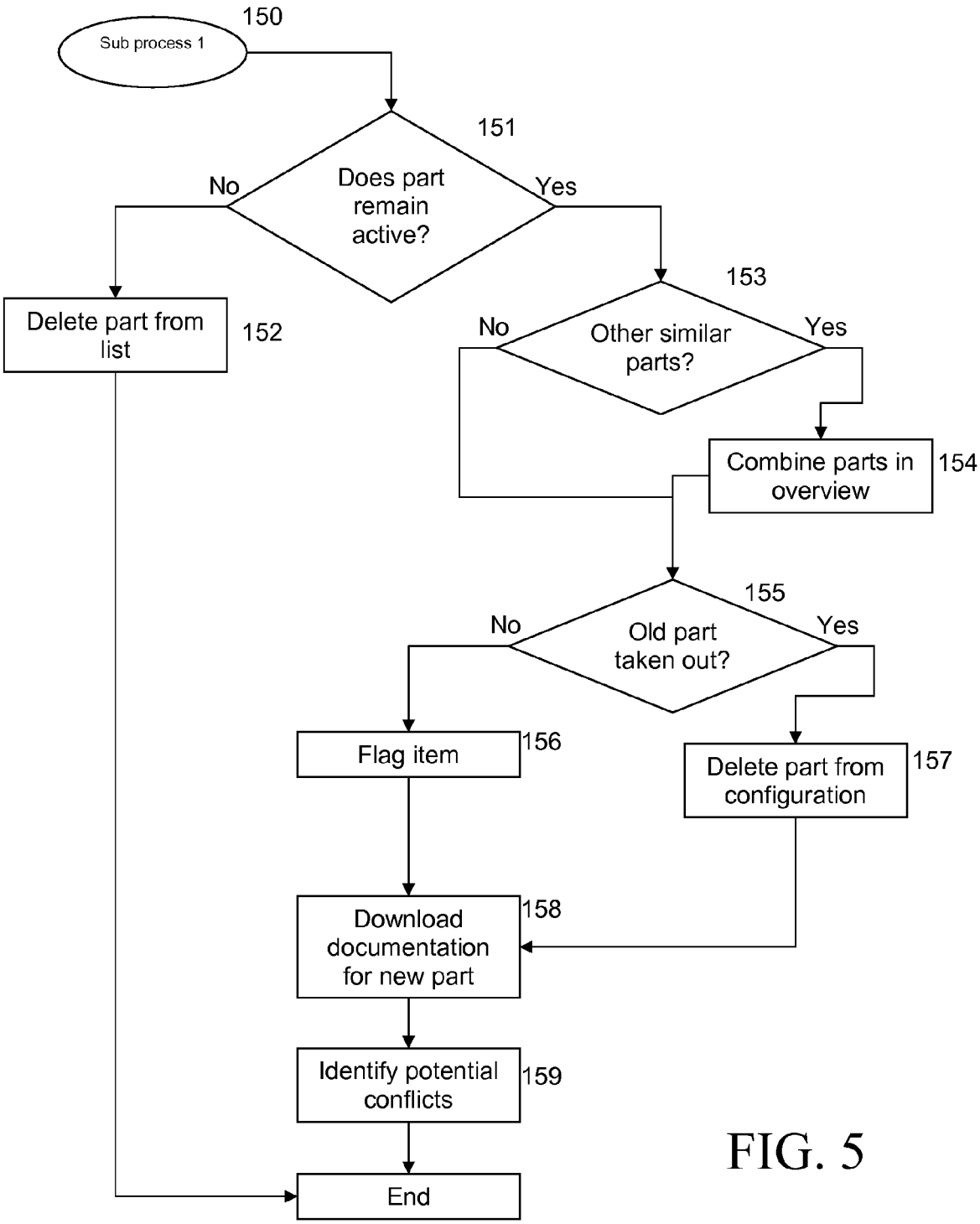
FIG. 5 depicts details of a sub-process of the flowchart of FIG. 4.

FIG. 5 depicts details of sub process 1. At step 151, a determination is made whether the part remains active. If no, the part is deleted at step 152 and the process ends. If yes, a determination is made whether there are other similar parts. If yes, all parts are combined in an overview at step 154. At step 155, a determination is made whether an old part was taken out. If yes, the part is deleted from the configuration at step 157. If not, the item is flagged at step 156, and documentation is downloaded for the new part at step 158. At step 159, potential conflicts or problems are identified.

Figure 6:
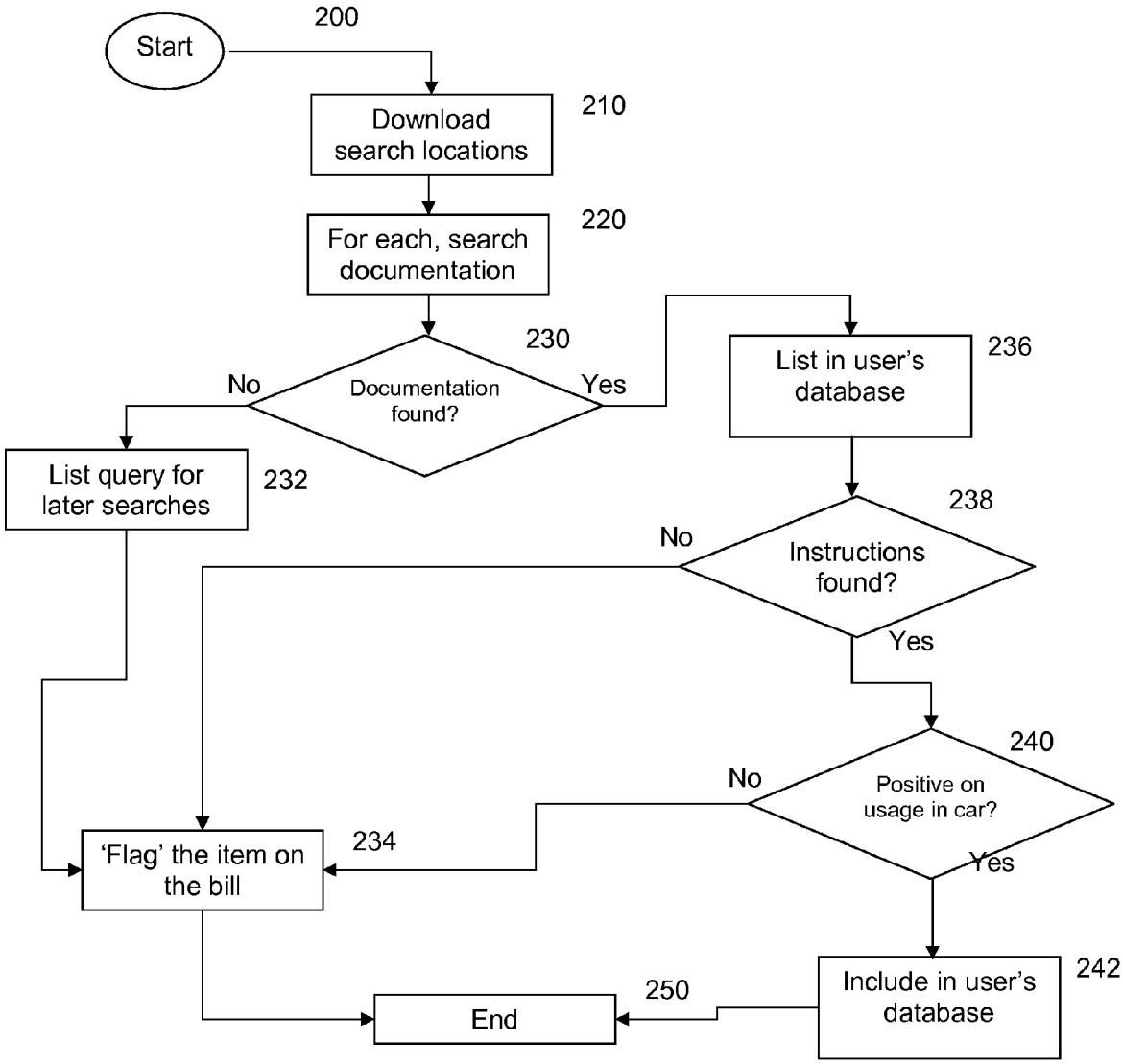
FIG. 6 depicts an illustrative flow chart for a reference application.

FIG. 6 depicts an illustrative flow chart for a reference application 28 involving downloading documentation. At step 200, the process is started when new RFID items are found. At step 210, a listing of locations where documentation is made available is downloaded, e.g., on the manufacturer's website, on a location contained in the RFID chip, documentation on the RFID chip itself, on another location found by creating a search strings based on device characteristics, etc. At step 220, for each of these locations, the process looks for documentation on the part or fluid. At step 230, a determination is made whether the documentation was found. If yes, then at step 236, the documentation is listed in the user's database and indicates if the part is original, modified, etc. If not, at step 232, the query to search for documentation at a later stage is listed, and at step 234, the item is 'flagged' on the bill for the user, such that the user is prompted that there is an unknown fluid or part in his car. At step 238, a determination is made whether instructions on usage of the item are made available by the manufacturer or community. If these are not available, then 'flag' the item. If these are available, then see if the instructions are positive about usage in the car and/or in its current configuration at step 240. This positive comment is then listed in the user's database at step 242. The process ends at step 250.

Figure 7:
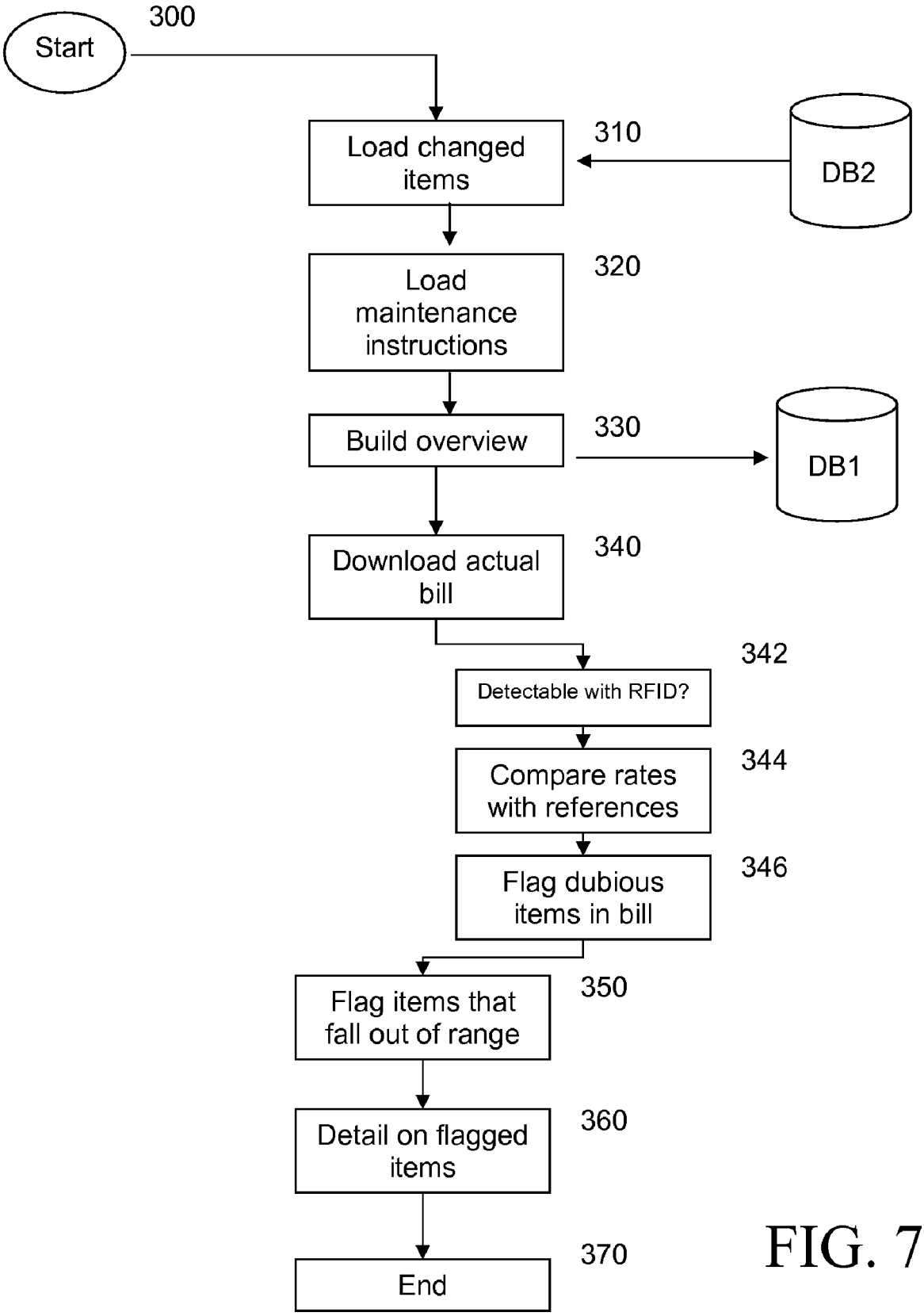
FIG. 7 depicts an illustrative flow chart of a billing application.

FIG. 7 depicts an illustrative flow chart of a billing application. At step 300, the process is started, e.g., after the hood has been closed, when the RFID reader is de-activated, or when billing is initiated. At step 310, load activities, new parts, fluids etc., into memory, originating from database DB2. At step 320, obtain maintenance instructions from the car manufacturer or dealer, including what should be done per mileage/time interval. At step 330, build a listing of information on these items, pointing out billing ranges, maintenance intervals for parts, etc. At step 340, optionally download the actual current bill. At step 342, determine if billed items would have been detected with an RFID, and at step 344, check rates against references and peers, and flag dubious items at step 346. At step 350, identify and 'flag' items that fall out of range, including speed of work. At step 360, optionally provide further details on flagged items, supporting the user's case with the service provider. End the process at step 370. Optionally, provide intermediate warnings to garage, owner, manufacturer, e.g., for warranty.

Figure 8:
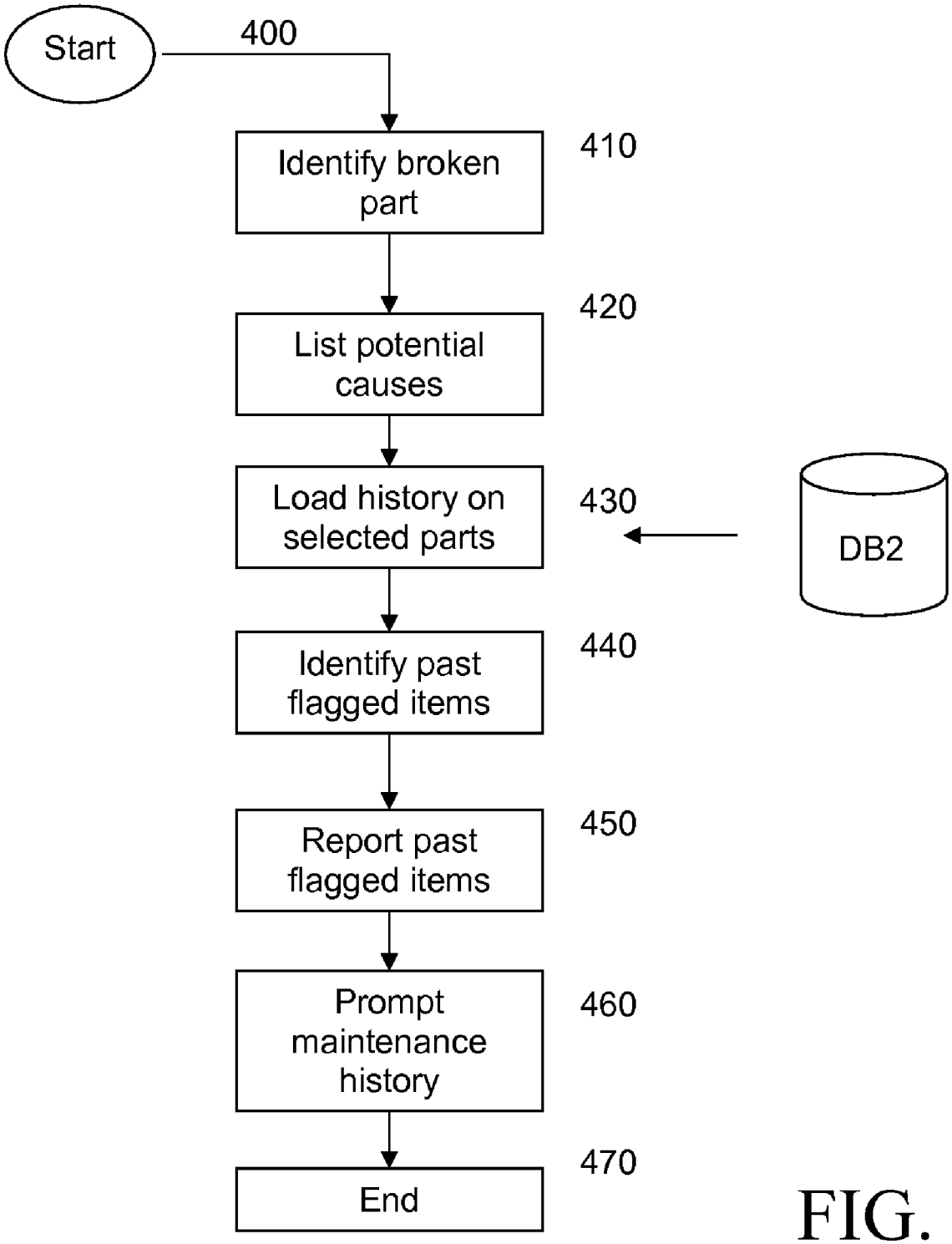
FIG. 8 depicts an illustrative flow chart for a parts tracking application.

FIG. 8 depicts an illustrative flow chart for a parts tracking application 24 that tracks broken parts. At step 400, the process is started when a part breaks, e.g., as detected by the car (warning lights) or indicated by user. At step 410, the item that broke down is identified and at step 420, potential causes are listed, e.g., from cause/effect documentation. This may include a series of events that could have caused the involved part to break down. At step 430, maintenance and replacement history on the involved parts are loaded. At step 440, past flagged items are identified. At step 450, flagged items are reported to the user, and at step 460, maintenance and replacement history is reported to the user (e.g., for use in repair and potential claims), as well as input from previous bills, etc. The process ends at step 470.

Figure 9:
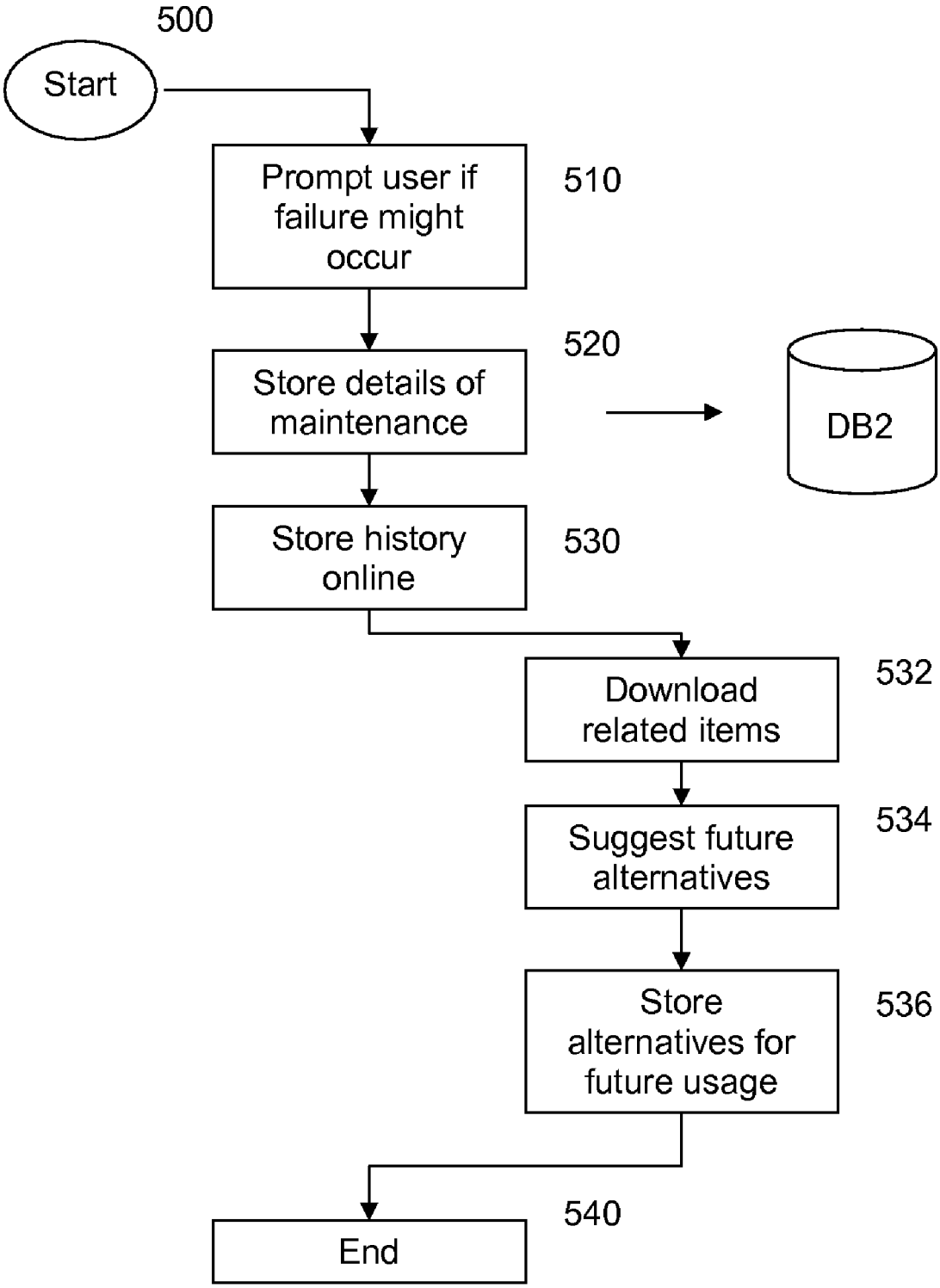
FIG. 9 depicts an illustrative flow chart for post processing parts data.

FIG. 9 depicts an illustrative flow chart for post processing parts data. At step 500, the process is started once maintenance has occurred. At step 510, the user is prompted if a previous failure happened with a similar protocol, sequence or replacement. At step 520, details of maintenance, bill, etc., are stored in a history database DB2 and optionally online at step 530. At step 532, related items from an online system are downloaded, interesting alternatives for the user are suggested at step 534, and alternatives to be prompted when replacement/repair/maintenance is up for involved items is stored at step 536. The process ends at step 540.

It is understood that the systems, functions, mechanisms, methods, engines and modules described herein can be implemented in hardware, software, or a combination of hardware and software. They may be implemented by any type of computer system or other apparatus adapted for carrying out the methods described herein. A typical combination of hardware and software could be a general-purpose computer system with a computer program that, when loaded and executed, controls the computer system such that it carries out the methods described herein. Alternatively, a specific use computer, containing specialized hardware for carrying out one or more of the functional tasks of the invention could be utilized. In a further embodiment, part of all of the invention could be implemented in a distributed manner, e.g., over a network such as the Internet.

The present invention can also be embedded in a computer program product, which comprises all the features enabling the implementation of the methods and functions described herein, and which—when loaded in a computer system—is able to carry out these methods and functions. Terms such as computer program, software program, program, program product, software, etc., in the present context mean any expression, in any language, code or notation, of a set of instructions intended to cause a system having an information processing capability to perform a particular function either directly or after either or both of the following: (a) conversion to another language, code or notation; and/or (b) reproduction in a different material form.

The foregoing description of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

What is claimed is:

1. A system for managing information related to a vehicle, comprising:

a radio frequency identification (RFID) reader configured to read data from RFID tags affixed to parts located throughout the vehicle, wherein each RFID tag uniquely identifies a part, wherein the RFID reader is further configured to read data from RFID tags affixed to packaging containing fluids suitable for use in the vehicle, wherein the packaging is external to the vehicle;

a data processing system configured to process the data obtained by the RFID reader; and a service application that provides service related information to an end user based on an installation or removal of a part from the vehicle.

2. The system of claim 1, wherein each RFID tag includes a part number and data regarding whether the part is new or refurbished.

3. The system of claim 1, further comprising a graphical user interface for displaying service related information to the end user.

4. The system of claim 1, wherein the data processing system is linked to a network to provide additional information relating to the part.

5. The system of claim 1, further comprising a database for storing parts information.

6. The system of claim 1, wherein the service application includes a parts tracking application that reports what parts were changed during a performed service.

7. The system of claim 1, wherein the service application includes a billing application for providing a cost estimate and a cost comparison for a performed service.

8. The system of claim 1, wherein the service application includes a reference application for obtaining parts documentation for parts affected by a performed service.

9. A vehicle having a system for managing parts information, comprising:

a plurality of parts, each having an radio frequency identification (RFID) tag that uniquely identifies the part;

an RFID reader configured to read data from the RFID tags, wherein the RFID reader is further configured to read data from RFID tags that are external to the vehicle;

a computer system having:

a data processing system configured to process parts data obtained by the RFID reader;

a database for storing parts data;

and a service application that provides service related information to an end user based on a detected part installation in or removal from the vehicle.

10. The vehicle of claim 9, wherein the service application includes a parts tracking application that reports what parts were changed during a performed service.

11. The vehicle of claim 9, wherein the service application includes a billing application for providing a cost estimate and a cost comparison for a performed service.

12. The vehicle of claim 9, wherein the service application includes a reference application for obtaining parts documentation for parts affected by a performed service.

* * * * *